US008302675B2

(12) United States Patent
Bull

(10) Patent No.: US 8,302,675 B2
(45) Date of Patent: Nov. 6, 2012

(54) SAFETY HEAT EXCHANGER FOR COMBINING A HEAT PUMP WITH A DEVICE OF A PUBLIC DRINKING WATER SUPPLY FACILITY

(75) Inventor: Detlef Bull, Bockelwitz (DE)

(73) Assignee: Oewa Wasser Und Abwasser GmbH, Leipzig (DE)

( * ) Notice: Subject to any disclaimer, the term of this patent is extended or adjusted under 35 U.S.C. 154(b) by 369 days.

(21) Appl. No.: 12/674,834

(22) PCT Filed: Aug. 26, 2008

(86) PCT No.: PCT/DE2008/001403

§ 371 (c)(1),
(2), (4) Date: May 13, 2010

(87) PCT Pub. No.: WO2009/026900

PCT Pub. Date: Mar. 5, 2009

(65) Prior Publication Data

US 2010/0288482 A1 Nov. 18, 2010

(30) Foreign Application Priority Data

Aug. 27, 2007 (DE) ..... 10 2007 040 629

(51) Int. Cl.
*F28D 7/10* (2006.01)

(52) U.S. Cl. ..... 165/285; 165/11.1; 165/286

(58) Field of Classification Search ..... 137/340; 165/11.1, 141, 150, 281, 284, 285, 286, DIG. 105
See application file for complete search history.

(56) References Cited

U.S. PATENT DOCUMENTS 2,597,744 A * 5/1952 Morrison ..... 165/155

(Continued)

FOREIGN PATENT DOCUMENTS

| | | | |
|---|---|---|---|
| AT | 375770 | B | 1/1984 |
| DE | 7927266 | U1 | 1/1980 |
| DE | 2834442 | A1 | 2/1980 |
| DE | 2926578 | A1 | 1/1981 |
| DE | 2930484 | A1 | 2/1981 |
| DE | 102004061441 | A1 | 6/2006 |

(Continued)

OTHER PUBLICATIONS

International Search Report dated Jan. 5, 2009.

*Primary Examiner* — John Rivell
*Assistant Examiner* — R. K. Arundale
(74) *Attorney, Agent, or Firm* — Norris McLaughlin & Marcus, P.A.

(57) ABSTRACT

A safety heat exchanger for combining a heat pump with a device of a drinking water supply facility for obtaining heat from drinking water. The heat exchanger includes a primary circulation loop (4) with drinking water, a secondary circulation loop (6) with antifreeze as a material that does not pose a health risk, and a tertiary circulation loop (7) with a coolant. The primary circulation loop (4) includes an inlet (3) connected to a drinking water supply facility and an outlet (5) with electrically controllable magnetic valves (16). The secondary circulation loop (6) and tertiary circulation loop (7) each have any dedicated difference pressure monitor (9, 18), which difference pressure monitors (9, 18) are controllably connected with the magnetic valves (16) such that when the difference pressure monitors (9, 18) detects a pressure difference in the secondary circulation loop (6) and/or in the tertiary circulation loop (7), the inlet (3) and the outlet (5) of the drinking water to the drinking water facility are closed, wherein the difference pressure monitor (9) of the secondary circulation loop (6) comprises an expansion vessel (11), a safety valve (12) and a manometer (13).

7 Claims, 2 Drawing Sheets

U.S. PATENT DOCUMENTS

| | | | | | |
|---|---|---|---|---|---|
| 2,658,728 | A | * | 11/1953 | Evans, Jr. | 165/11.1 |
| 4,090,554 | A | * | 5/1978 | Dickinson | 165/11.1 |
| 4,148,355 | A | * | 4/1979 | Gehring | 165/286 |
| 4,538,674 | A | * | 9/1985 | Schluderberg | 165/70 |
| 6,561,265 | B2 | * | 5/2003 | Ohira et al. | 165/154 |

FOREIGN PATENT DOCUMENTS

| | | | |
|---|---|---|---|
| GB | 2004635 | A | 4/1979 |
| JP | 60060449 | A | 4/1985 |
| WO | 2005/045324 | A | 5/2005 |

* cited by examiner

SAFETY HEAT EXCHANGER FOR COMBINING A HEAT PUMP WITH A DEVICE OF A PUBLIC DRINKING WATER SUPPLY FACILITY

This application is a 371 application of PCT/DE2008/001403 filed Aug. 26, 2008, which claims priority to the German application DE 10 2007 040 629.2 filed Aug. 27, 2007.

BACKGROUND OF THE INVENTION

The invention relates to safety heat exchanger for a combination of a heat pump with a device of a drinking water supply facility, with a primary circulation loop with drinking water, a secondary safety circulation loop with an anti-freeze material that does not pose a health risk, and a tertiary circulation loop with a coolant.

DE 102004061441 B4 discloses a heat exchanger for use in a drinking water sanctuary. For safety reasons, a third intermediate circulation loop is proposed in order to be able to operate the primary circulation with drinking water, with the intent to protect the drinking water in drinking water sanctuaries.

DE 2834442 A1 already disclosed a combination of a drinking water supply facility with a heat exchanger for obtaining heat. For obtaining domestic heat based on a heat pump system, a partial quantity of water is to be removed from the pipe network of a central water supply facility, from which heat is removed with a heat exchanger. As a precaution, a heat storage device is provided between the heat pump and the heat exchanger of the partial water quantity withdrawn from the pipe network. The storage device should ensure that heat generation during the night is independent for a limited time, when a very low flow velocity can be expected in the pipes of the central water supply facility. The intermediate storage device is unable to prevent the coolant from coming into contact with the drinking water in the event of a leak.

DE 2930484 A1 also proposes to use a heat pump in a drinking water facility. The heat exchanger is integrated in a drinking water pipe with fittings. The main water pipe should be arranged as a loop so as to ensure continuous heat supply in the main water pipe. A circulation pump can be used to circulate the drinking water in the main water supply pipe arranged in the loop. The circulation pump is controlled depending on the temperature of the drinking water.

DE 792 7266 U1 discloses a condenser for heat pumps with an inner tube surrounded by an outer tube. The enclosed annular space is filled with water and connected with an overpressure safety valve and a switching device.

AT 375770 B also discloses any double-walled cooling coil with a pressure indicator, wherein the cooling coil contains water as separating fluid. The waste heat from oil is to be used for heating service water which should not come into contact with the oil. The pressure indicator is not suitable for a unpressurized primary medium is not protected from freezing.

DE 2926578 A1 relates to a safety heat exchanger for heating drinking water that is to be separated from the coolant loop. Direct heating of the drinking water should be avoided, because the coolant and the drinking water would then only be separated by a single wall. This is not in compliance with increased safety requirements in drinking water supply.

In DE 2926578 A1, at least one heat pipe is provided for heat transfer, wherein the end of the heat pipe located outside the fluid container is arranged in a coolant vessel through which a coolant flows. The coolant vessel is connected with the fluid container by way of a double wall. The heat pipe extends through the double wall. This arrangement forms a safety heat exchanger which ensures separation of the coolant from the drinking water and prevents coolant from entering the fluid. The safety arrangement is monitored to show indirectly a decrease in efficiency in the event of a leak.

In the closed heat pipe circulation loop, an intermediate circulation loop with an extremely high conductivity is connected between the coolant and the drinking water. The intermediate circulation loop is formed by heat pipes. The heat pipes are either evacuated or filled with water. However, the heat pipes may also be filled with ethanol. In this way, the heat pipe has a fill which is either neutral with respect to the drinking water or harmless.

BRIEF SUMMARY OF THE INVENTION

A skilled artisan will therefore be encouraged to employ an intermediate circulation loop to protect the drinking water when using a heat pump wherein the intermediate circulation loop is filled with drinking water or with harmless alcohols. However, this alone cannot completely satisfy the requirements for the protection of drinking water, because coolant can be transferred to the drinking water unnoticed if the coolant circulation loop and the intermediate circulation loop develop a leak.

Finally, the heat pump disclosed in DE 1020040614441 B4 has an intermediate circulation loop which is not primarily designed to protect the drinking water. Instead, the primary circulation loop is filled with drinking water to protect groundwater. The intermediate circulation loop protects the arrangement from freezing and is therefore filled with brine or a water-glycol mixture which is not viewed as being harmless to the drinking water supply. The DE 1020040614441 B4 is hence exclusively directed to a heat exchanger system with a geothermal collector with a drinking water fill, wherein the heat exchanger is typically protected against freezing. The safety heat exchanger is therefore temperature-controlled. A return line is provided which is opened by a thermostat valve when the permissible cooling temperature is attained. In addition, the intermediate circulation loop has a circulation system sized to be adequate for practically preventing freezing.

For this reason, the drinking water is in reality not completely safe, because the drinking water circulation loop is in direct contact with the water-glycol intermediate circulation loop. If the intermediate circulation loop and the primary circulation loop leak, the water-glycol mixture can enter the drinking water. Glycol in a drinking water supply is considered a substance that poses a health risk. As a result, the heat exchanger is not suitable for the combination of a heat pump with a device of a public drinking water supply facility.

The invention is directed to a safety heat exchanger for the combination of a heat pump with a device of a public drinking water supply facility, which has a primary circulation loop with drinking water, a safety circulation loop with a substance that does not pose a health risk, and a tertiary circulation loop with a coolant. The safety heat exchanger should prevent harm to the drinking water in the public drinking water supply. The safety heat exchanger should also prevent a decrease in the quality of the drinking water commensurate with drinking water regulations and protect the health of the population from the harmful contamination. The drinking water must still be fit for consumption and its purity must not be diminished when recovering heat from drinking water intended for human consumption.

According to the invention, the object is attained with a safety heat exchanger which is characterized in that the primary circulation loop includes an inlet connected with a drinking water supply facility and an outlet with electrically controllable magnetic valves, wherein the primary circulation loop or the coolant circulation loop has a higher operating pressure than the safety circulation loop and the safety circulation loop is provided with a pressure monitor which is controllably connected with the magnetic valves such that the inlet and the outlet of the drinking water to the drinking water facility are closed off in the event of a pressure loss in the primary circulation loop or in the coolant circulation loop.

According to an embodiment of the invention, the safety heat exchanger includes a circulation pump for the drinking water in the primary circulation loop, a feed pump for the coolant in the intermediate circulation loop, and a compressor in the coolant circulation loop, which are controllably connected with the pressure monitor and are stopped in the event of a pressure loss in the primary circulation loop or into cooling circulation loop. The pressure monitor may also generate a warning signal.

In this way, harm to the drinking water through coolant or anti-freeze compound can be reliably and safely prevented. If a leak occurs between the primary circulation loop or the coolant, overpressure is generated in the intermediate circulation loop, which is monitored with the pressure monitor. In the event of an overpressure or a reduced pressure different from a control pressure, the pumps in all circulation hoops are switched off, and the inlet and outlet of the drinking water to the drinking water supply facility is closed off by magnetic valves, which will be described below with reference to two exemplary embodiments.

The exemplary embodiments will now be described in more detail with reference to the drawings. Advantageous embodiments of the invention are recited in the dependent claims. Shown in form of schematic diagrams are in:

DETAILED DESCRIPTION OF THE INVENTION

Figure 1:
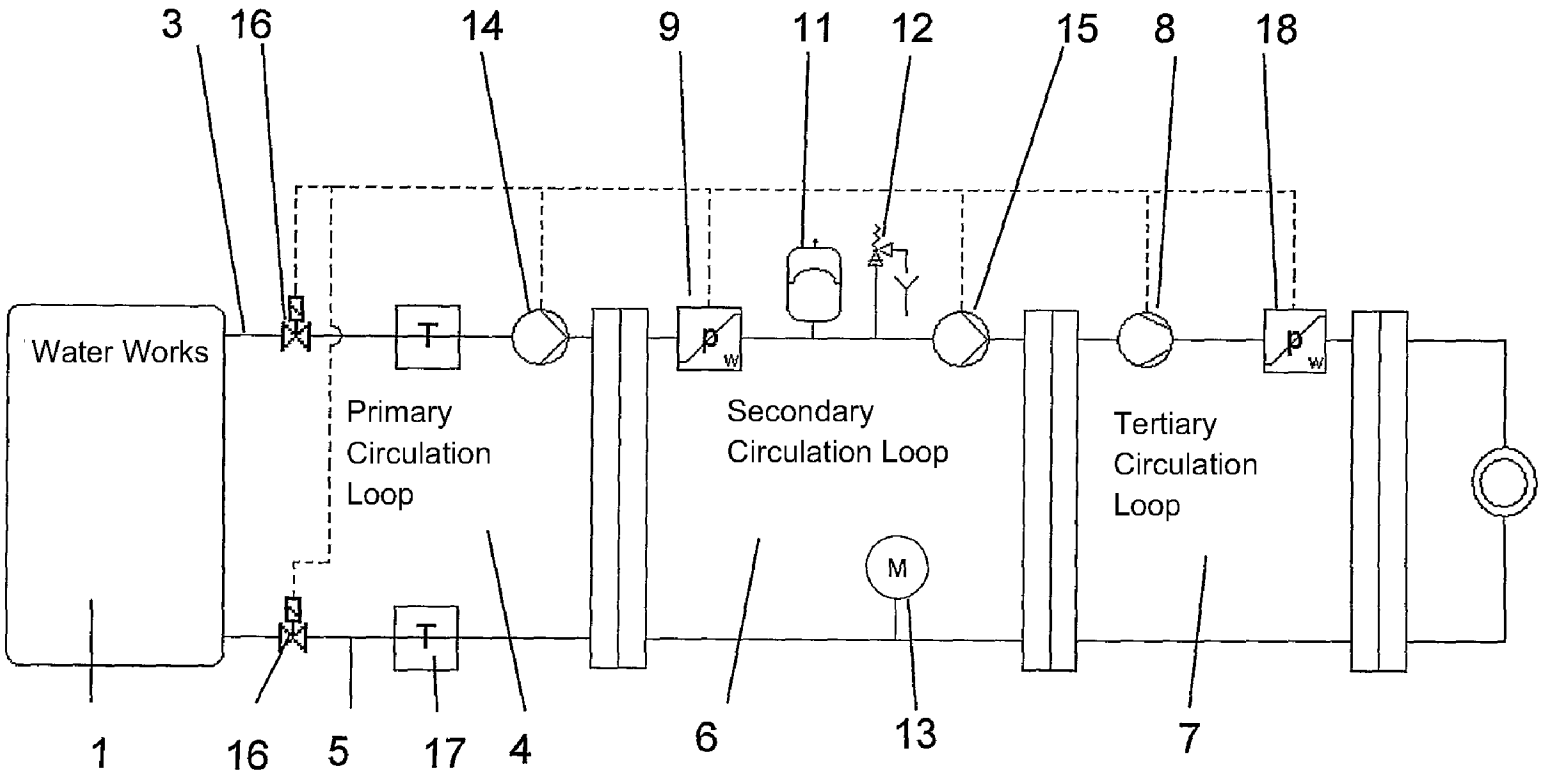
FIG. 1 a safety heat exchanger with a primary circulation loop, which has a higher operating pressure than the safety circulation loop, and FIG. 2 a safety heat exchanger with a primary circulation loop, which has a lower operating pressure than the safety circulation loop.

FIG. 1 shows a safety heat exchanger for the combination of a heat pump with a device of a drinking water supply facility which is represented in the first exemplary embodiment by a waterworks 1. In the second exemplary embodiment illustrated in FIG. 2, the device of the drinking water supply facility is illustrated as a drinking water vessel. The invention should not be considered as limited to facilities of this type. Devices and facilities of drinking water supply facilities may include, for example, facility components for drinking water extraction, pumping stations, pressure boosting stations or drinking water supply networks.

The device of the drinking water supply facility in FIG. 1 is a waterworks 1, in which primarily for the consumption of the facility and for saving energy, the geothermal energy contained in the drinking water is transferred by a safety heat exchanger in combination with a heat pump to a higher temperature level than the temperature of the drinking water.

The safety heat exchanger includes an inlet 3 to a primary circulation loop 4 and an outlet 5 leading to the waterworks 1 for the drinking water containing the geothermal energy and having an essentially constant temperature level. The primary circulation loop 4 is connected for heat transfer with a secondary safety circulation loop 6 or an intermediate circulation loop which contains an anti-freeze material that does not pose a health risk, so that the safety circulation loop 6 is prevented from freezing when heat is withdrawn. The intermediate circulation loop is preferably filled with a mixture containing 90% water and 10% ethanol. The safety circulation loop 6 is also connected with a tertiary coolant circulation loop 7 containing a conventional coolant. The coolant is transported in a conventional manner by a compressor 8 to an unillustrated condenser and an evaporator with an expansion valve, all of which are connected by a piping system to form the coolant circulation loop 7.

To monitor the operation of the safety heat exchanger, a pressure monitor with a difference pressure monitor 9 is provided in the safety circulation loop 6. The pressure monitor also includes various components of a safety assembly, in particular an expansion vessel 11, a safety valve 12 and a manometer 13. The safety assembly can maintain the pressure in the safety circulation loop 6 at a substantially constant level. The difference pressure monitor 9 is controllably connected with the circulation pump 14 for the drinking water in the primary circulation loop 4, the feed pump 15 for the antifreeze material in the safety circulation loop 6, and with the compressor 8 in the coolant circulation loop 7.

In addition, servo-controlled magnetic valves 16 are disposed in the primary circulation loop 4 in the inlet 3 to the circulation pump 14 and in the outlet 5 for the drinking water, so that inlet and outlet can be closed off even in the event of a power failure. The magnetic valves 16 are connected in parallel with the difference pressure monitor 9, so that when the difference pressure monitor 9 is triggered, the magnetic valves 16 are closed and the circulation pump 14 and the feed pump 15 as well as the compressor 8 are stopped. To increase safety, the primary circulation loop 4 can be additionally equipped with thermometers 17. A pressure switch 18 is connected in parallel in the coolant circulation loop 7 as an additional safety measure.

In a safety heat exchanger according to FIG. 1, the pressure conditions are defined such that the primary circulation loop 4 with the drinking water loop is generally operated at a higher pressure than the safety circulation loop 6. For example, if the pressure in the primary circulation loop 4 is at least 4 bar, then the safety circulation loop 6 is adjusted to a pressure of less than or equal to 2 bar. The pressure in the coolant circulation loop 7 is set to a significantly higher pressure of about 20 bar. For example, if a leak occurs in the evaporator, then the pressure in the safety circulation loop 6 increases. In the exemplary embodiment, the difference pressure monitor 9 is triggered when the safety circulation loop 6 has a pressure Pmax of 3 bar. The pressure switch 18 is triggered when the coolant circulation loop 7 has a pressure Pmin of 20 bar. A control circuit connected with the difference pressure monitor 9 and the pressure switch 18 immediately switches the safety heat exchanger off and causes the magnetic valves 16 to close. Because the pressure increase in the intermediate circulation loop 6 is monitored and the circulation pump 14 is switched off, the coolant can be prevented from entering the drinking water in any situation caused by a mishap.

In the event of a leak in the primary circulation loop 4 of the heat exchanger, the facility is also automatically shut off as a result of the pressure increase in the safety circulation loop 6. The difference pressure monitor 9 likewise reacts at a pressure of Pmax above 3 bar. The error signal is applied to a safety circuit of the heat pump controller, causing the facility to be automatically shut off. A signaling device can be provided which produces, for example, an acoustic, optical, mechanical or electrical warning signal. The electrical warning signal can optionally also be transmitted to a remote monitoring center at the waterworks 1. Likewise, an error message about the mishap of the heat pump can be transmitted via SMS to a standby mobile phone.

Figure 2:
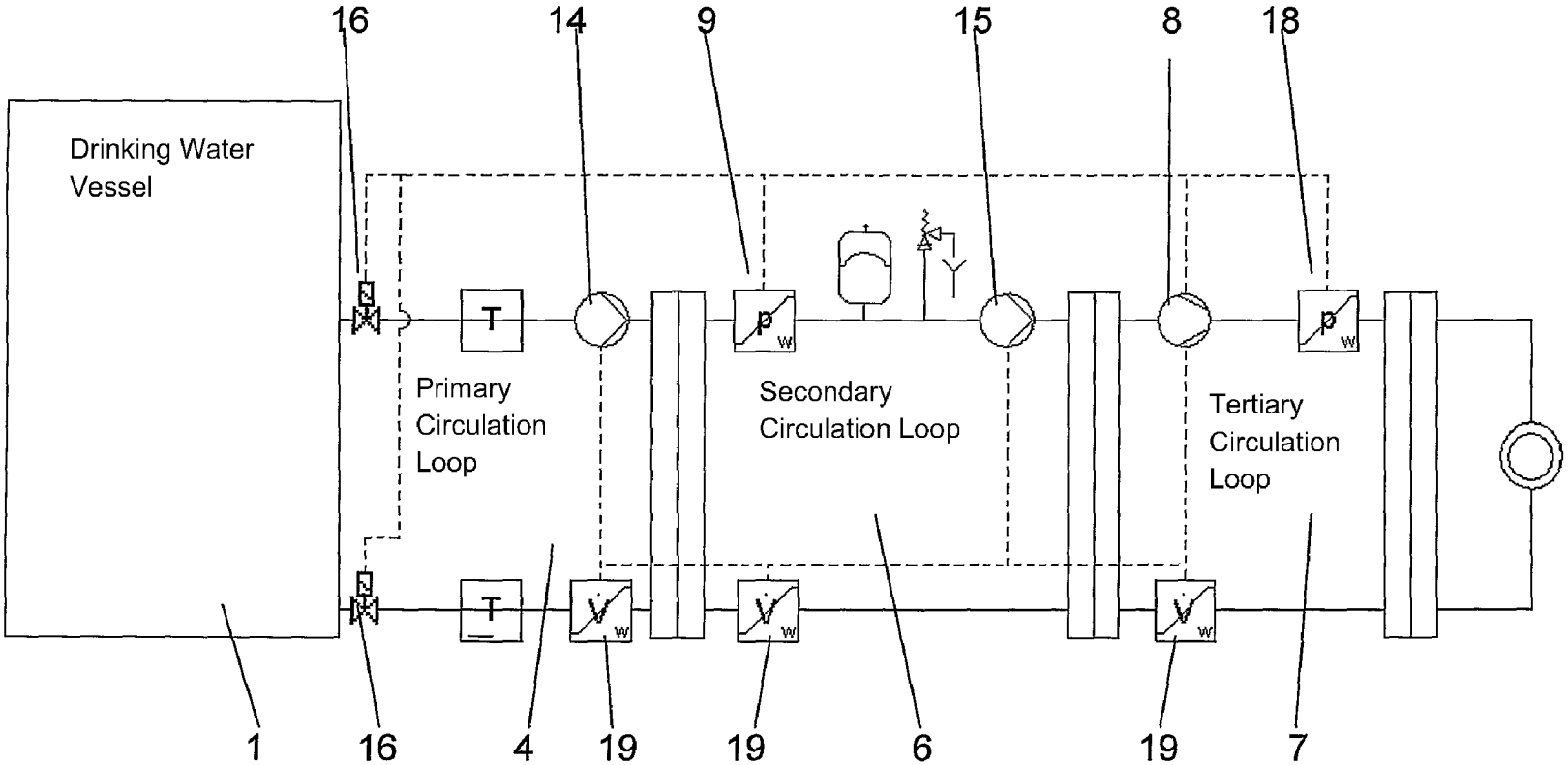

In a safety heat exchanger according to FIG. 2, the pressure conditions are defined such that the primary circulation loop 4 with the drinking water loop is generally operated at the lowest pressure of the overall system. The embodiment is particularly advantageous when the drinking water is at ambient pressure, for example with a drinking water vessel 2. The switching point of the pressure switch 18 in the coolant circulation loop 7 is here at a pressure Pmin of 20 bar. If a leak occurs in the evaporator, the pressure in the safety circulation loop 6 is expected to increase. The difference pressure monitor 9 is triggered at a pressure Pmax of 3 bar of the safety circulation loop 6 and triggers a switch-off of the circulation pump 14, the feed pump 15 and the compressor 8. The magnetic valves 16 in the primary circulation loop 4 are closed at the same time. If a leak occurs in the heat exchanger of the primary circulation loop 4, the safety heat exchanger is also automatically switched off as a result of the pressure decrease in the intermediate circulation loop. The difference pressure monitor 9 likewise reacts at a pressure Pmin of 1.5 bar.

In addition, to enhance safety, each loop of the heat transfer may include flow control switches 19 which react by switching off all pumps and the compressor 8 when the volume flow falls below a value of 15 l/min. The flow control switch has, for example, a switching point of 15 liters per minute.

With this design, leaks can be quickly identified, so that remedial measures can be taken within a short time. By arranging the safety circulation loop 6 with the proposed pressure monitor in a safety heat exchanger, the heat pump can be switched off if a mishap occurs, without harming the drinking water supply. The pressure monitor can also be installed in similar systems without increasing their complexity.

The invention claimed is:

1. A safety heat exchanger for combining a heat pump with a device of a drinking water supply facility for obtaining heat from drinking water, comprising a primary circulation loop (4) with drinking water, a secondary circulation loop (6) containing antifreeze as a material that does not pose a health risk, and a tertiary circulation loop (7) with a coolant, wherein the primary circulation loop (4) includes an inlet (3) connected to a drinking water supply facility and an outlet (5) with electrically controllable magnetic valves (16), wherein the secondary circulation loop (6) and tertiary circulation loop (7) each have a dedicated difference pressure monitor (9, 18), which difference pressure monitors (9, 18) are controllably connected with the magnetic valves (16) such that when the difference pressure monitors (9, 18) detects a pressure difference in the secondary circulation loop (6) and/or in the tertiary circulation loop (7), the inlet (3) and the outlet (5) of the drinking water to the drinking water facility are closed, wherein the difference pressure monitor (9) of the secondary circulation loop (6) comprises an expansion vessel (11), a safety valve (12) and a manometer (13).

2. The safety heat exchanger according to claim 1, wherein the pressure in the primary circulation loop (4) is either higher or lower than the pressure in the secondary circulation loop.

3. The safety heat exchanger according to claim 1, wherein the pressure in the primary circulation loop (4) is at least 4 bar and the secondary circulation loop (6) is set to a pressure of less than or equal to 2 bar, wherein the pressure in the tertiary circulation loop (7) is set to a significantly higher pressure of about 20 bar.

4. The safety heat exchanger according to claim 1, wherein a corresponding servo-controlled magnetic valve (16) is disposed in the primary circulation loop (4) in the inlet (3) to a circulation pump (14) and in the outlet (5) for the drinking water.

5. The safety heat exchanger according to claim 1, wherein the difference pressure monitor (9) in the secondary circulation loop (6) and the difference pressure monitor (18) in the tertiary circulation loop (7) are controllably connected in parallel.

6. The safety heat exchanger according to claim 1, wherein the difference pressure monitor (9) and the difference pressure monitor (18) for switching off the safety heat exchanger and for closing the magnetic valves (16) in parallel are controllably connected with a compressor (8), a circulation pump (14) and a feed pump (15) by way of a control circuit.

7. The safety heat exchanger according to claim 1, wherein the switching point of the difference pressure monitor (18) in the tertiary circulation loop (7) is at the pressure $P_{min}$ of 20 bar, wherein the difference pressure monitor (9) has a switching point at a pressure of $P_{max}$=3 bar and at a pressure of $P_{min}$=1.5 bar of the secondary circulation loop (6).

* * * * *